US007637723B2

(12) United States Patent
Sadasivam

(10) Patent No.: US 7,637,723 B2
(45) Date of Patent: Dec. 29, 2009

(54) CAVITATION DETECTION DEVICE AND METHOD

(75) Inventor: Vinodkumar Sadasivam, St. Louis, MO (US)

(73) Assignee: Emerson Electric Co, St. Louis, MO (US)

( * ) Notice: Subject to any disclaimer, the term of this patent is extended or adjusted under 35 U.S.C. 154(b) by 886 days.

(21) Appl. No.: 11/161,150

(22) Filed: Jul. 25, 2005

(65) Prior Publication Data

US 2007/0017284 A1 Jan. 25, 2007

(51) Int. Cl.
*F04B 49/02* (2006.01)
*F04B 49/06* (2006.01)
*G05F 1/70* (2006.01)

(52) U.S. Cl. ..... 417/44.1; 417/44.11; 318/438; 318/729; 702/64; 702/182

(58) Field of Classification Search ..... 318/432, 318/433, 438, 727, 729, 798, 799, 802, 805, 318/812; 417/44.1, 44.11, 45; 702/34–38, 702/58, 59, 64, 65, 75–77, 182–184
See application file for complete search history.

(56) References Cited

U.S. PATENT DOCUMENTS

| | | | | |
|---|---|---|---|---|
| 6,449,567 | B1 * | 9/2002 | Desai et al. | 702/58 |
| 6,636,011 | B2 | 10/2003 | Sadasivam et al. | |
| 6,663,349 | B1 | 12/2003 | Discenzo et al. | |
| 6,709,240 | B1 | 3/2004 | Schmalz et al. | |
| 6,828,751 | B2 | 12/2004 | Sadasivam et al. | |
| 6,859,740 | B2 | 2/2005 | Stephenson et al. | |
| 2003/0060094 | A1 * | 3/2003 | Motsenbocker | 440/6 |

OTHER PUBLICATIONS

"Protect Sealed and Sealless Pumps with Power Monitoring", Flowserve Corporation, May 2002, pp. 1-4.*

* cited by examiner

*Primary Examiner*—David A. Rogers
(74) *Attorney, Agent, or Firm*—Locke Lord Bissell & Liddell LLP

(57) ABSTRACT

Cavitation detection systems and methods include generating a signal representing the power factor of a motor driving a pump, analyzing the power factor signal and determining the presence of cavitation based on the analysis of the power factor signal. The power factor may be estimated using various estimation schemes. Analyzing the signal includes filtering the power factor signal.

40 Claims, 5 Drawing Sheets

CAVITATION DETECTION DEVICE AND METHOD

BACKGROUND

Cavitation is related to the formation of vapor bubbles in a fluid control application such as a pump or valve. When fluid flows through a restriction, velocity increases and pressure decreases causing vapor bubbles to form. Once the fluid flows through the restriction, the fluid flow decelerates and the pressure recovers, causing the vapor bubbles to violently collapse. In a water pump, for example, cavitation detection is necessary for several reasons, including preventing damage to the pump and pump components such as seals, reducing acoustic noise and insuring proper flow levels. Typically, various types of sensors, such as water level, flow, turbidity or pressure, are used for cavitation detection purposes. Sensors, however, add complexity and cost.

The present invention addresses shortcomings associated with the prior art.

SUMMARY OF THE DISCLOSURE

In accordance with certain teachings of the present disclosure, cavitation detection systems and methods include generating a signal representing the power factor of a motor driving a pump, analyzing the power factor signal and determining the presence of cavitation based on the analysis of the power factor signal. Analyzing the signal includes filtering the power factor signal.

In certain embodiments, the power factor is estimated using various estimation schemes. For example, one estimation method includes sensing a zero-cross angle of a current waveform applied to phase windings of the motor and computing the difference between the sensed current zero-cross angle and a predetermined demand voltage angle. Another estimation method includes applying desired voltage amplitude and frequency signals to the motor driving the pump, receiving an indication of current applied to phase windings of the motor and estimating the voltage applied to the phase windings of the motor. The power factor is estimated based on the phase winding current, the estimated voltage applied to the phase windings and the voltage amplitude and frequency signals.

BRIEF DESCRIPTION OF THE DRAWINGS

Other objects and advantages of the invention will become apparent upon reading the following detailed description and upon reference to the drawings in which.

Figure 1:
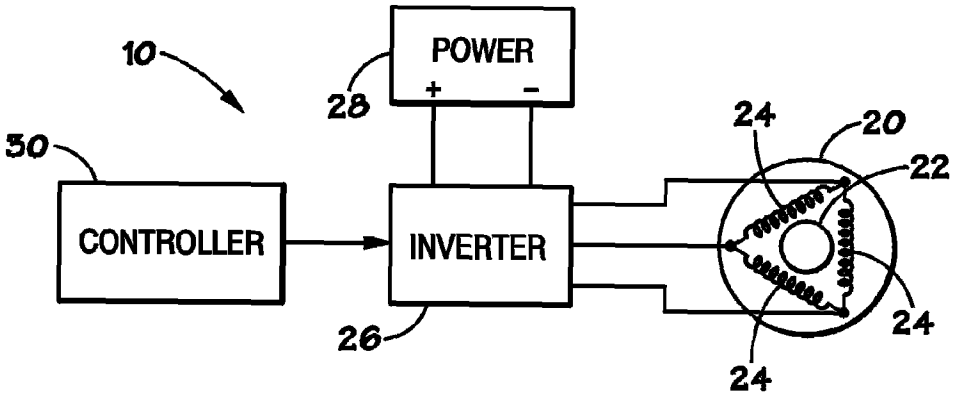
FIG. 1 is a block diagram conceptually illustrating aspects of an induction motor system.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DISCLOSURE

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Induction motors are popular in pump applications for several reasons, including high robustness, reliability, low price and high efficiency. A typical induction motor includes a stationary member, or stator, that has a plurality of windings disposed therein. A rotating member, or rotor, is situated within the stator to rotate relative thereto. In a three-phase induction motor, for example, a rotating magnetic field is established by applying three-phase sinusoidal alternating voltages to the stator windings. The rotating magnetic field interacts with the rotor windings to effect rotation of the rotor.

Power conversion systems are commonly used to provide the multiphase AC power to the induction motor for variable speed applications. An example of such a power conversion system is a DC-to-AC inverter bridge, which typically includes power semiconductor switching devices connected in a bridge formation between the DC bus lines and output terminals of the power conversion system. The switching devices are controlled to connect the power on the DC bus lines to the system output terminals in a desired pattern such that AC output signals having the desired fundamental frequency and amplitude are synthesized from the DC power on the DC bus lines. Various modulation strategies may be employed for controlling the inverter switching devices to deliver power, including sine wave Pulse-Width Modulation ("PWM").

The natural characteristic of an induction motor will allow the rotor speed to decrease with increasing torque load on the shaft, at constant voltage amplitude and frequency. To counter this and maintain a more constant speed, speed control methods vary the voltage and frequency to control the speed of the rotor. A secondary purpose of this is to prevent saturation of the motor stack, which will lead to over heating of the motor. Thus, control schemes used in applications where the load on the motor shaft varies over a wide range (for example, a water pump) should be capable of applying proper stator voltage amplitude and frequency to the motor so as to maintain shaft speed and prevent over heating of the motor. Moreover, it may be desirable to control the motor over a wide range of speeds.

Some induction motor control schemes are based on controlling the power factor of the motor (generally, the power factor is calculated based on the phase difference between the voltage and currents). When cavitation begins, the torque load on the motor changes. This change is reflected in the power factor of the motor. Thus, the power factor signal can be analyzed to yield an indication of the presence of air in the liquid being pumped, or cavitation. Further, the analysis of the power factor signal can show the amount of air present, providing an indication of the severity of cavitation. Commonly assigned U.S. Pat. Nos. 6,636,011 and 6,828,751, both incorporated by reference, disclose induction motor control schemes based on estimates of power factor. In accordance with teachings herein, an estimated power factor signal can be used to detect cavitation.

FIG. 1 is a block diagram of an exemplary rotating electric machine, such as a three-phase induction motor system 10, in accordance with aspects of the present disclosure. The motor 10 includes a stator 20 and a rotor 22. The stator 20 includes a plurality of windings 24 that receive AC power from an inverter 26. The inverter 26 receives DC power from a power source 28. A controller 30 includes a schedule of voltage and frequency constants, and provides control inputs to the inverter to vary the voltage and frequency to achieve the desired speed. The controller 30 may be implemented, for example, with any type of digital controller such as a digital signal processor (DSP) chip, microcontroller or microprocessor. An example of a suitable controller is a model ADMC328 from Analog Devices.

Figure 2:
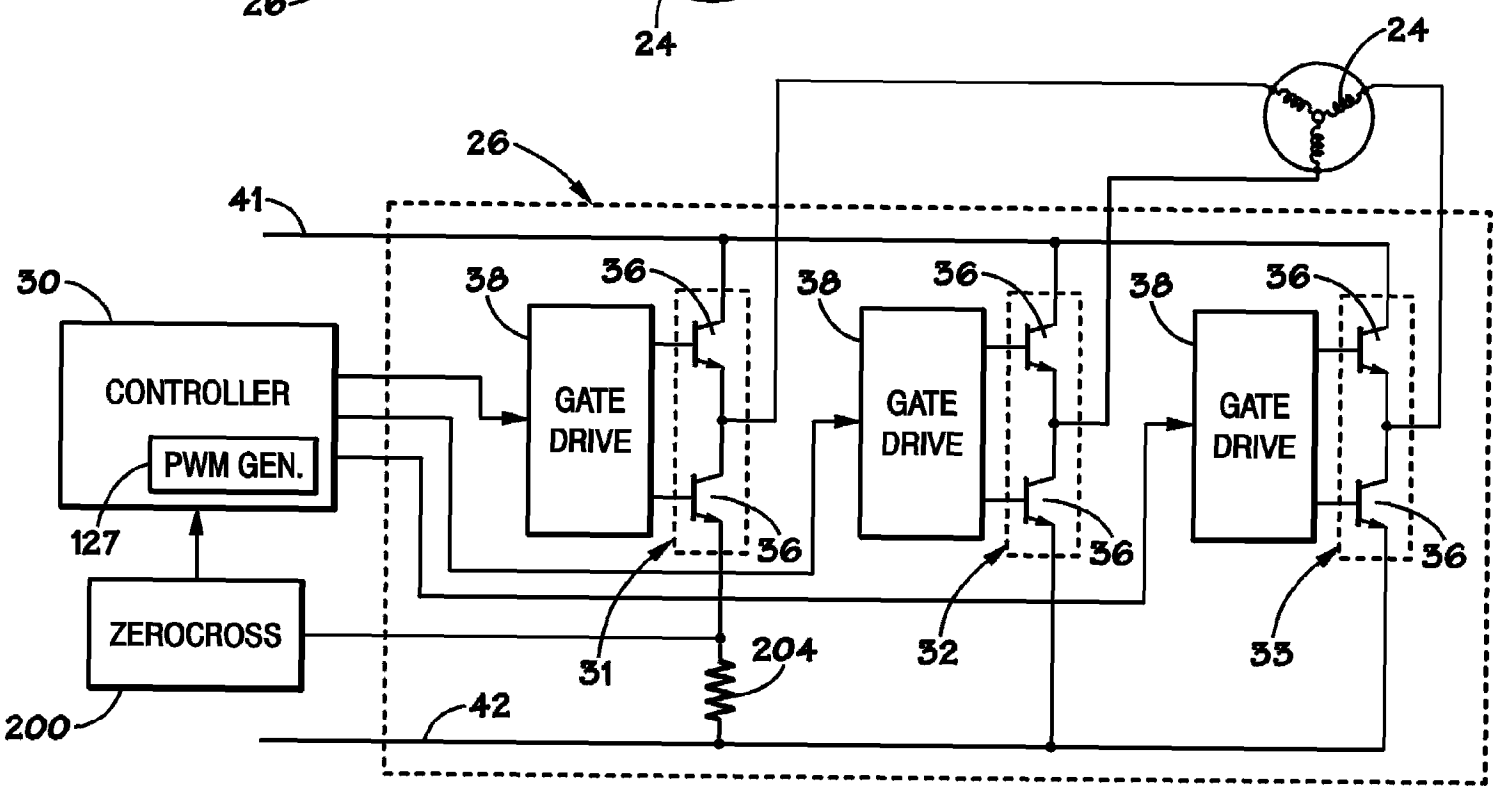
FIG. 2 is a schematic diagram illustrating aspects of an inverter system in accordance with certain teachings of the present disclosure.

FIG. 2 illustrates portions of an exemplary inverter 26 that may be used to control an induction motor system such as the system 10 shown in FIG. 1. The exemplary three-phase inverter 26 includes three inverter legs 31, 32, 33 corresponding to the windings 24 of the three motor phases. Each leg 31, 32, 33 includes upper and lower switching devices 36 connected in a bridge formation between the positive and negative lines 41, 42 of the DC bus. The switching devices 36 may comprise any suitable switching device, such as bi-polar devices, power MOSFETs, IGBTs, etc.

The switching devices 36 of the three inverter legs 31, 32, 33 are driven by corresponding gate drivers 38 so as to connect the power on the DC bus lines 41, 42 to the motor windings 24 in a desired pattern, such that AC output signals having the desired frequency and amplitude are synthesized from the DC power on the DC bus lines 41, 42. In certain embodiments of the invention, PWM schemes are used for controlling the inverter switching devices 36. In the illustrated embodiment, the gate drivers 38 have inputs connected to receive the output of a PWM generator 127 implemented by the controller 30.

The power factor can be determined in a number of different ways. For example, the power factor can be estimated by analyzing the inverter zero-cross angle. Referring to FIG. 2, a resistor 204 is included between the lower switching device 36 of one of the inverter leg 31 and the negative DC bus 42. Using a single inverter leg, such as inverter leg 31, to determine the zero-cross angle greatly simplifies the circuitry required to implement the current zero-cross detection, though any or all of the inverter legs 31, 32, 33 may be used for the zero-crossing detection. The current zero-crossing is determined by the zero-cross detection circuit 200, then provided to the controller 30 to calculate the power factor angle. In this implementation scheme a level change in the signal is used to signify the zero-cross of the phase current, though other schemes for detecting the zero-crossing are contemplated, such as through use of the PWM signals.

Figure 3:
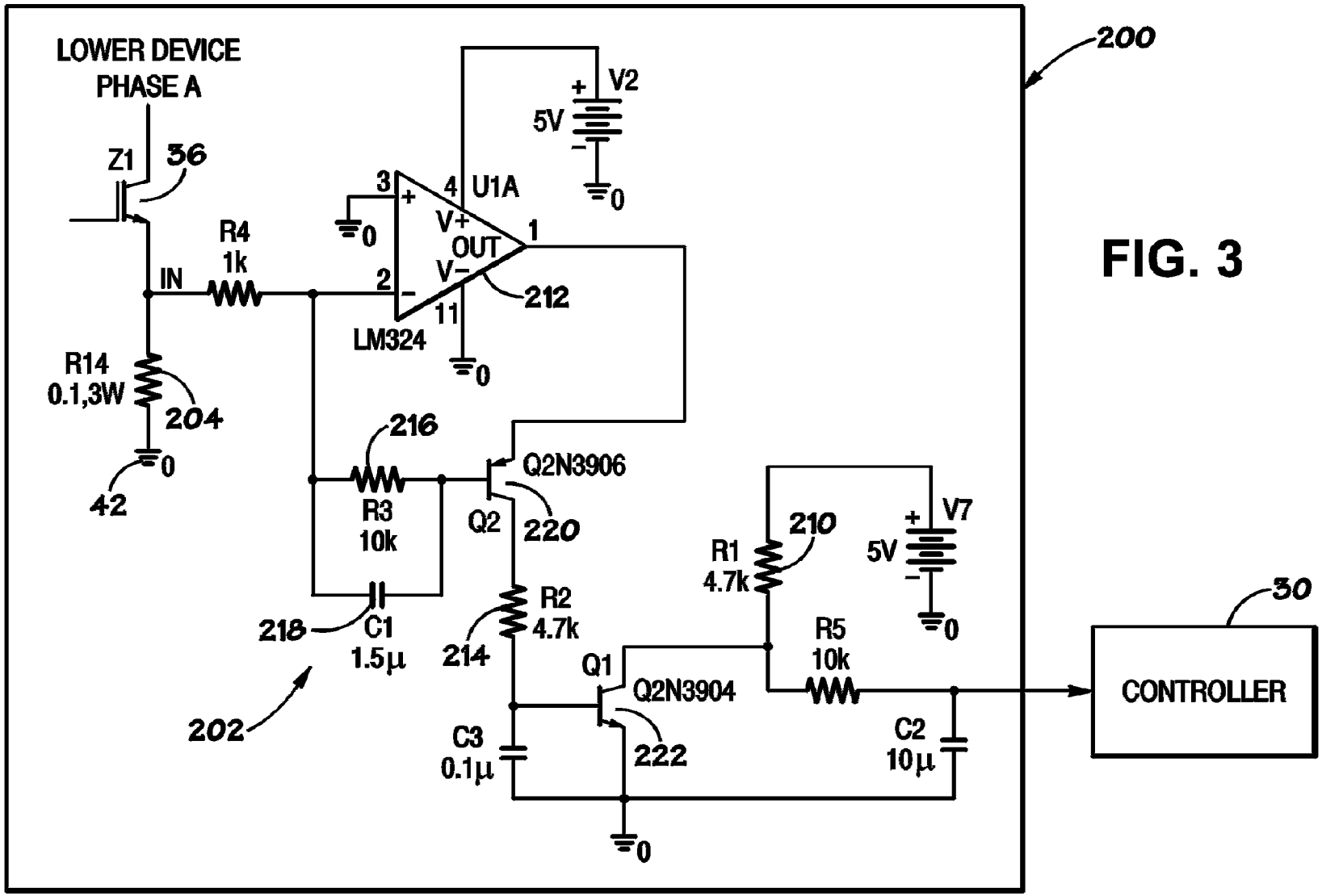
FIG. 3 is a schematic diagram illustrating a phase current zero-cross angle detection circuit.

FIG. 3 is a schematic diagram of an exemplary zero-cross detection circuit 200. As noted above, the resistor 204 is included between the lower switching device 36 of one of the inverter legs 31, 32, 33 and the negative DC bus 42. For sake of simplicity, the first inverter leg 31 is referenced in this description, though any of the inverter legs 31, 32, 33 could be used for this purpose.

The signal obtained from the resistor 204 is fed to conditioning circuitry 202 that produces a square wave type output signal based on the zero-crossing of the phase current. The output is connected to the controller 30. In one embodiment, the output is connected to a level sensitive interrupt pin on the DSP implementing the controller 30, providing an output edge to the DSP each time the current crosses zero. The phase angle is stored in the DSP memory when interrupted. To increase the noise immunity in one embodiment, the interrupt is enabled only for 60° before and after the zero-crossing of the phase command voltage. This window of operation works effectively for most of the practical working conditions of the drive system.

The conditioning circuitry 202 functions by converting the current flowing in the inverter phase leg 31 to a voltage signal using the current shunt resistor 204. The first step in processing the signal is to buffer the signal from the resistor 204 and remove the high frequency PWM switching noise. In the illustrated circuit 202, this is accomplished using an operational amplifier 212, two resistors 214, 216, and a capacitor 218 in an inverting opamp filter configuration. A PNP transistor 220 is inserted in the feedback path of the opamp 212 to differentiate between the positive portion of the phase current and the negative portion of the phase current. This is accomplished using the inherent base emitter diode in the PNP transistor 220. When the voltage across the current shunt resistor 204 becomes positive, the voltage at the output of the opamp 212 is pulled down which turns off the transistor 220. Alternatively, when the voltage across the current shunt resistor 204 becomes negative, the transistor 220 is turned on.

An NPN transistor 222 translates the current flowing in the transistor 220 into a logic level voltage signal, which can be read by the controller 30. When the PNP transistor 220 is ON, current flows in the base of transistor 222, which turns it ON and produces a low-level signal at the input of the controller 30. When transistor 220 is OFF, transistor 222 turns off which produces a high level signal at the input of the controller 30. The final result of the circuit 202 is to turn the bipolar sinusoidal current waveform following in the shunt resistor 204 into a logic level signal with transitions at the current zero-crossing points.

By definition, the power factor angle is the phase difference between the phase current and terminal voltage of the motor. Since the PWM algorithm accurately reproduces the commanded voltage, the generated phase angle in the controller is used in this computation. By using the voltage phase angle and the sensed zero-crossing instant of the current, the power factor angle can be computed. Once the zero-cross angle of the current is sensed, the difference between this angle and the zero-cross angle of the voltage is computed to get the power factor angle. This power factor angle is low pass filtered to increase noise immunity and to avoid sudden changes in the command voltage of the motor. The filtering may be done by any acceptable means—the power factor angle is low pass filtered by software in one exemplary embodiment. This results in a cost effective control scheme for power factor angle estimation.

Figure 4:
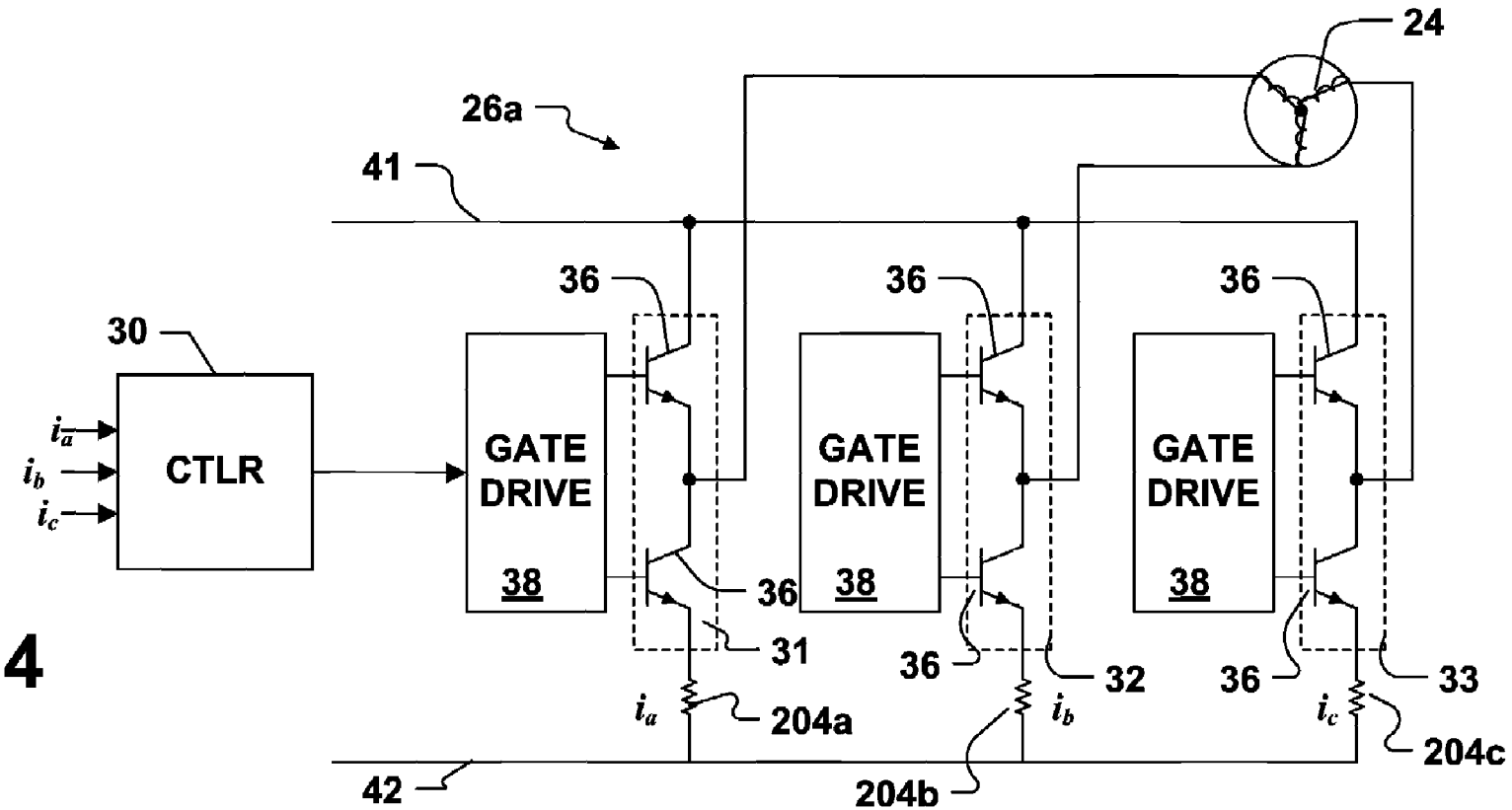
FIG. 4 is a schematic diagram illustrating aspects of another inverter system in accordance with certain teachings of the present disclosure.

In other embodiments, the power factor is calculated based on the motor phase currents. FIG. 4 is a circuit diagram illustrating portions of another exemplary inverter **26*a*. As with the inverter 26 shown in FIG. 2, the inverter 26*a* includes three inverter legs 31, 32, 33 corresponding to the windings 24 of the three motor phases. Each leg 31, 32, 33 includes upper and lower switching devices 36 connected in a bridge formation between the positive and negative lines 41, 42 of the DC bus. Again, the switching devices 36 may comprise any suitable switching device. The switching devices 36 are driven by corresponding gate drivers 38, and PWM schemes may be used for controlling the inverter switching devices 36. Resistors 204***a*,204*b*,204*c* are connected between the lower switching devices 36 of the corresponding inverter legs 31, 32, 33 and the line 42 of the DC bus. The resistors 204*a*,204*b*, 204*c* are used to sense the phase currents $i_a$, $i_b$, and $i_c$, which are fed back to the controller 30.

The power factor is calculated from the reactive power (Qpower) and real power (Ppower) to the motor as follows:

$$pf = \cos\left(a\tan\left(\frac{\text{Q_power}}{\text{P_power}}\right)\right)$$

The reactive and real power to the motor are calculated from the two axis coordinate system currents. The two axis system currents $I_\alpha$ and $I_\beta$, and voltages $V_\alpha$ and $V_\beta$ are calculated from the three phase variables as follows:

$$\begin{bmatrix} F\alpha \\ F\beta \end{bmatrix} = \begin{bmatrix} 1 & 0 & 0 \\ 0 & \frac{1}{\sqrt{3}} & \frac{-1}{\sqrt{3}} \end{bmatrix} \begin{bmatrix} Fa \\ Fb \\ Fc \end{bmatrix}$$

The reactive and real power are calculated as shown below. Corrections are made to the real power to account for inverter losses by subtracting a constant value $P_{loss}$.

$$P_\text{power} = I\alpha * V\alpha + I\beta * V\beta - P_{loss}$$

$$Q_\text{power} = I\alpha * V\beta - I\beta * V\alpha$$

The terminal variables (phase currents and voltages) are calculated from the sensed leg variables as shown below $$\begin{bmatrix} Fa \\ Fb \\ Fc \end{bmatrix} = \begin{bmatrix} \text{Fa_leg} - \text{Fb_leg} \\ \text{Fb_leg} - \text{Fc_leg} \\ \text{Fc_leg} - \text{Fa_leg} \end{bmatrix}$$

As noted above, PWM schemes are typically used for controlling the inverter switching devices. The terminal voltages are estimated as below from the inverter bus voltage, duty cycle of the current switching cycle and the leg current for the corresponding phase.

$$\text{Vabc_leg} = \text{Vabcn_ref} - \Im(\text{ileg_abc}, \text{DC_abc}, \text{Vbus})$$

Vabc_leg is the instantaneous voltage vector at the terminals of the motor, Vabcn_ref is the commanded terminal voltage vector of the motor, Iabc_leg is the instantaneous phase current vector of the motor, and $DC_{abc}$ is the duty cycle vector for each phase of the motor.

The voltage drop associated with the inverter switching devices and sensing resisters are accounted for as below.

$$\Im(\text{ileg_abc}) = \begin{cases} \text{ileg_abc} < 0 \Rightarrow \text{DC_abc} * \\ (Vbus - \text{V_igbt} - \text{V_diode}) - \text{V_shunt} - \text{V_igbt} \\ \text{ileg_abc} > 0 \Rightarrow \text{DC_abc} * \\ (Vbus - \text{V_igbt} - \text{V_diode}) - \text{V_shunt} - \text{V_diode} \end{cases}$$

The effect of cavitation on the motor is a change in load torque. The change in load is reflected in the power factor. The power factor is independent of speed at the motor's rated load if the voltage/frequency schedule is designed to provide constant flux. Variations in the power factor can be filtered out to yield a measure of air in the liquid being pumped.

Figure 5:
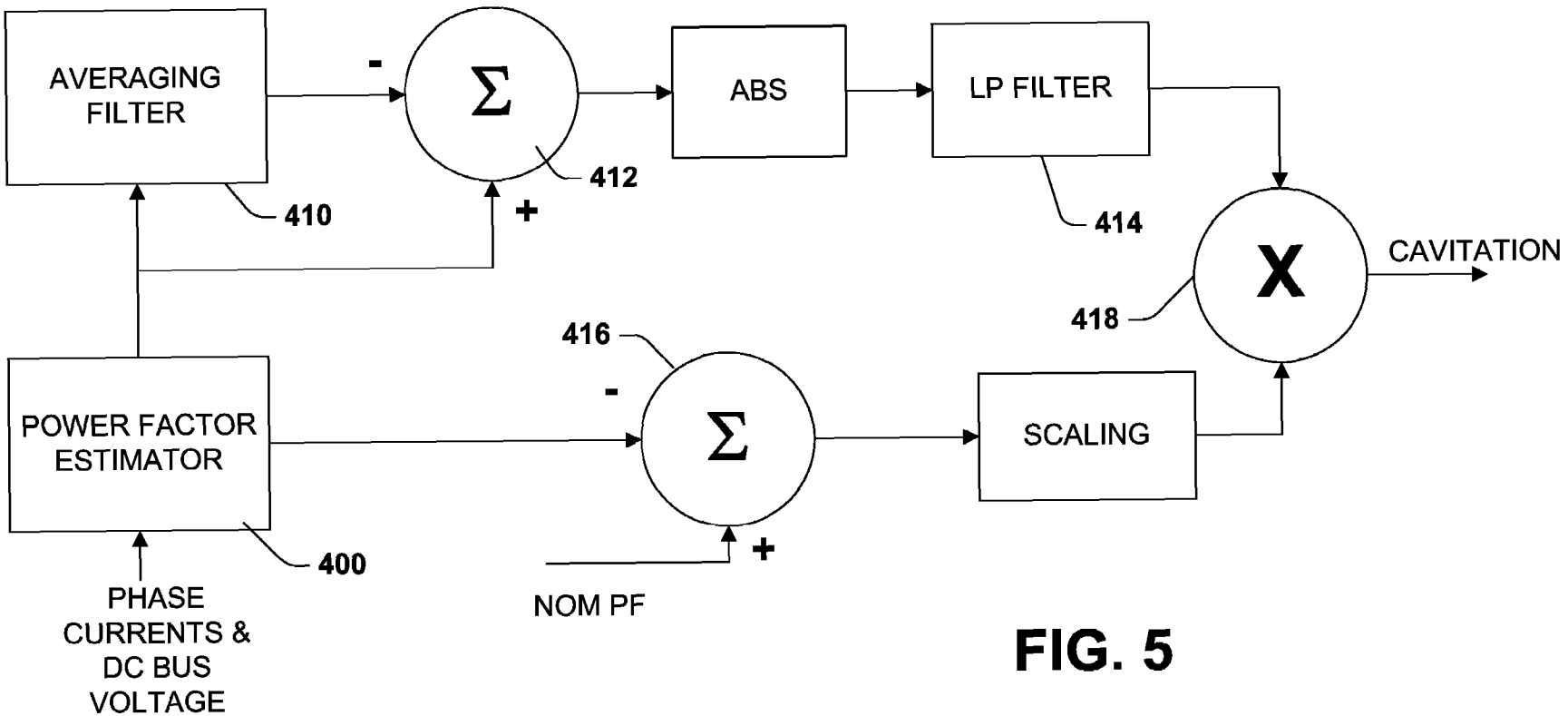
FIG. 5 is a block diagram showing a cavitation detection system.
Figure 6:
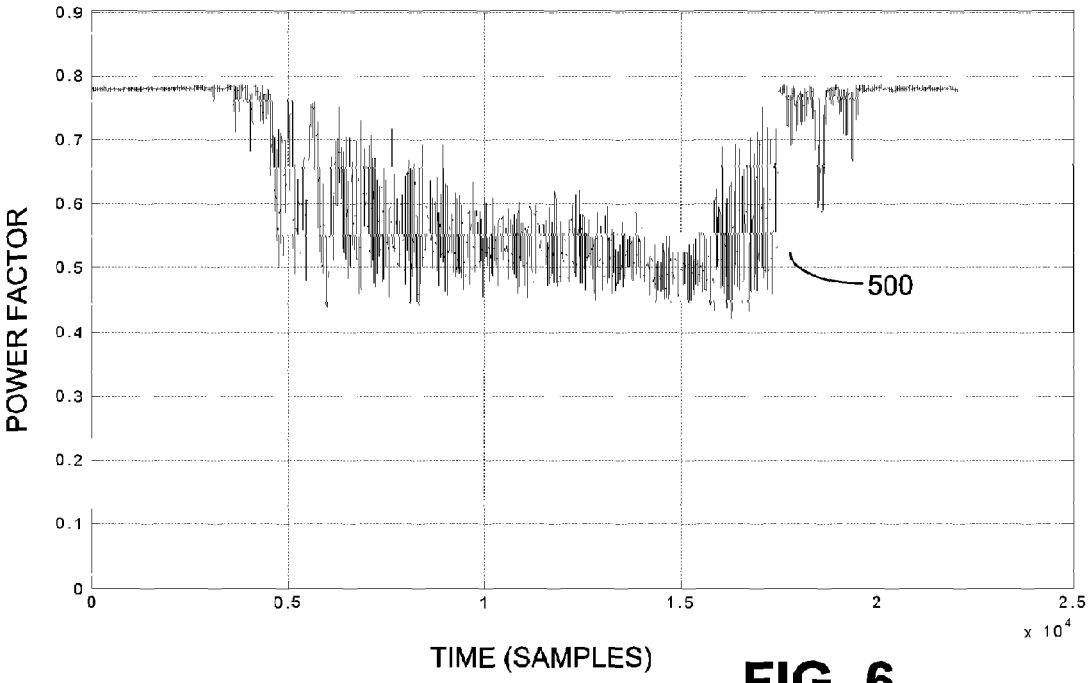
FIG. 6 illustrates a power factor signal during the onset of cavitation.
Figure 7:
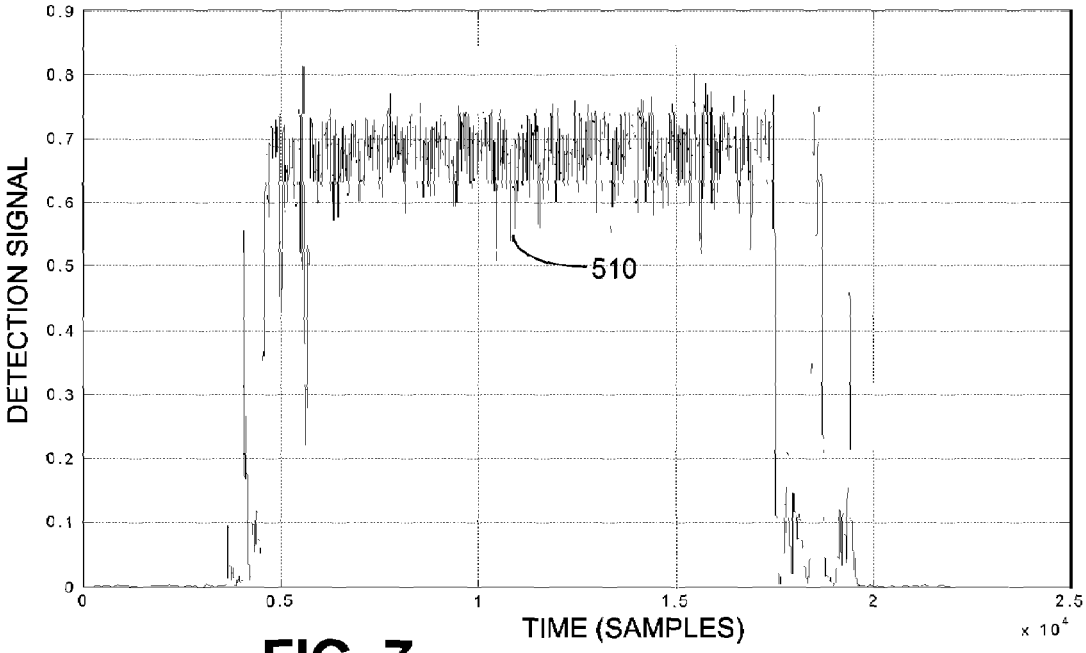
FIG. 7 illustrates a cavitation detection signal during cavitation.

The cavitation sensing portion of the system is conceptually illustrated in FIG. 5. For example, a power factor estimator 400 receives current and voltage information to calculate the system power factor. The power factor from the power factor estimator 400 is filtered by an averaging filter 410 and then summed with the unfiltered estimated power factor at a summing junction 412. The absolute value of the output of the summing junction 412 is then filtered by a low-pass filter 414, resulting in a measure of noise in the power factor signal. The estimated power factor signal is also input to a summing junction 416 along with a nominal power factor value. The output of the summing junction 416 is scaled to provide a compensation for loss of flow, which is combined with the measure of noise in the power factor signal at a junction 418, resulting in a cavitation signal. FIG. 6 shows a power factor signal 500 during onset of cavitation. In FIG. 7, a cavitation detection signal 510 is shown during cavitation.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A method for sensing cavitation in a pump driven by a motor, comprising:

generating a power factor signal;

analyzing the power factor signal; and determining the presence of cavitation based on the analysis of the power factor signal.

2. The method of claim 1, further comprising determining the severity of the cavitation based on the analysis of the power factor signal.

3. The method of claim 1, wherein determining the presence of cavitation includes filtering the power factor signal.

4. The method of claim 1, wherein determining the presence of cavitation includes determining the presence of noise in the power factor signal.

5. The method of claim 1, wherein generating a power factor signal includes estimating the power factor signal.

6. The method of claim 5, wherein estimating the power factor signal includes:

applying desired voltage amplitude and frequency signals to the motor;

receiving an indication of current applied to phase windings of the motor;

estimating the voltage applied the phase windings of the motor; and wherein the power factor is estimated based on the phase winding current, the estimated voltage applied to the phase windings and the voltage amplitude and frequency signals.

7. The method of claim 5, wherein estimating the power factor signal includes:

sensing a zero-cross angle of a current waveform applied to phase windings of the motor;

computing the difference between the sensed current zero-cross angle and a predetermined demand voltage angle.

8. The method of claim 7 wherein sensing the zero-cross angle of the current waveform applied to the phase windings comprises sensing the zero-cross angle of the current waveform applied to one of a plurality of phase windings.

9. A method for sensing cavitation in a pump driven by a motor, comprising:

generating a power factor signal;

analyzing the power factor signal; and determining the presence of cavitation based on the analysis of the power factor signal, wherein determining the presence of cavitation includes compensating for a loss of flow.

10. The method of claim 9, further comprising determining the severity of the cavitation based on the analysis of the power factor signal.

11. The method of claim 9, wherein determining the presence of cavitation includes filtering the power factor signal.

12. The method of claim 9, wherein determining the presence of cavitation includes determining the presence of noise in the power factor signal.

13. The method of claim 9, wherein generating a power factor signal includes estimating the power factor signal.

14. The method of claim 13, wherein estimating the power factor signal includes:

applying desired voltage amplitude and frequency signals to the motor;

receiving an indication of current applied to phase windings of the motor;

estimating the voltage applied the phase windings of the motor; and wherein the power factor is estimated based on the phase winding current, the estimated voltage applied to the phase windings and the voltage amplitude and frequency signals.

15. The method of claim 13, wherein estimating the power factor signal includes:

sensing a zero-cross angle of a current waveform applied to phase windings of the motor;

computing the difference between the sensed current zero-cross angle and a predetermined demand voltage angle.

16. The method of claim 15 wherein sensing the zero-cross angle of the current waveform applied to the phase windings comprises sensing the zero-cross angle of the current waveform applied to one of a plurality of phase windings.

17. A pump system, comprising:

a motor including a stator, a rotor situated relative to the stator to rotate relative to the stator, and a plurality of phase windings situated within the stator;

a power source connected to the windings to output AC power thereto; and a controller connected to the power source, the controller programmed to detect cavitation by analyzing a power factor signal.

18. The pump system of claim 17, wherein the power factor signal represents an estimated power factor value.

19. The pump system of claim 17, wherein the controller comprises a DSP.

20. The pump system of claim 17, wherein the motor is an induction motor.

21. The pump system of claim 20, wherein the power factor value is estimated based on the AC power output to the windings.

22. The pump system of claim 21, wherein the power source includes an inverter having a DC bus with positive and negative lines and a plurality of inverter legs connected between the positive and negative lines corresponding to the phase windings, and wherein the voltage applied to each of the phase windings is estimated further in response to the DC bus voltage and the inverter leg current for the corresponding phase winding.

23. The pump system of claim 22, further comprising:

each inverter leg including first and second switching devices connected between the positive and negative lines of the DC bus;

a resistor connected between one of the first and second switching devices and one line of the DC bus; and a current zero-cross detection circuit connected to receive a signal from the resistor and output an indication of the current zero-crossing to the controller.

24. A cavitation detection system, comprising:

a controller providing control signals to a power source for selectively energizing phase windings of a motor driving a pump;

the controller analyzing a power factor signal and detecting cavitation in response thereto.

25. The cavitation detection system of claim 24, wherein the controller comprises a DSP.

26. The cavitation detection system of claim 24, wherein the power factor signal represents an estimated power factor value.

27. The cavitation detection system of claim 26, wherein the controller estimates the power factor value based on the AC power output to the windings.

28. The cavitation detection system of claim 27, wherein the power source includes an inverter having a DC bus with positive and negative lines and a plurality of inverter legs connected between the positive and negative lines corresponding to the phase windings, and wherein the voltage applied to each of the phase windings is estimated further in response to the DC bus voltage and the inverter leg current for the corresponding phase winding.

29. A pump system, comprising:

a motor including a stator, a rotor situated relative to the stator to rotate relative to the stator, and a plurality of phase windings situated within the stator;

a power source connected to the windings to output AC power thereto: and a controller connected to the rower source, the controller programmed to detect cavitation by analyzing a power factor signal, wherein detecting cavitation includes compensating for a loss of flow.

30. The pump system of claim 29, wherein the motor is an induction motor.

31. The pump system of claim 29, wherein the controller comprises a DSP.

32. The pump system of claim 29, wherein the power factor signal represents an estimated power factor value.

33. The pump system of claim 32, wherein the power factor value is estimated based on the AC power output to the windings.

34. The pump system of claim 33, wherein the power source includes an inverter having a DC bus with positive and negative lines and a plurality of inverter legs connected between the positive and negative lines corresponding to the phase windings, and wherein the voltage applied to each of the phase windings is estimated further in response to the DC bus voltage and the inverter leg current for the corresponding phase winding.

35. The pump system of claim 34, further comprising:

each inverter leg including first and second switching devices connected between the positive and negative lines of the DC bus;

a resistor connected between one of the first and second switching devices and one line of the DC bus; and a current zero-cross detection circuit connected to receive a signal from the resistor and output an indication of the current zero-crossing to the controller.

36. A cavitation detection system, comprising:

a controller providing control signals to a power source for selectively energizing phase windings of a motor driving a pump;

the controller analyzing a power factor signal and detecting cavitation in response thereto, wherein detecting cavitation includes compensating for a loss of flow.

37. The cavitation detection system of claim 36, wherein the power factor signal represents an estimated power factor value.

38. The cavitation detection system of claim 36, wherein the controller comprises a DSP.

39. The cavitation detection system of claim 37, wherein the controller estimates the power factor value based on the AC power output to the windings.

40. The cavitation detection system of claim 39, wherein the power source includes an inverter having a DC bus with positive and negative lines and a plurality of inverter legs connected between the positive and negative lines corresponding to the phase windings, and wherein the voltage applied to each of the phase windings is estimated further in response to the DC bus voltage and the inverter leg current for the corresponding phase winding.

* * * * *